US005224406A

United States Patent [19]

Nasu

[11] Patent Number: 5,224,406

[45] Date of Patent: Jul. 6, 1993

[54] APPARATUS FOR CUTTING LAMINATE

[75] Inventor: Nobuo Nasu, Fukuyama, Japan

[73] Assignees: Kabushiki Kaisha Kawakami Seisakusho; Namx Ltd., Hiroshima, Japan

[21] Appl. No.: 990,746

[22] Filed: Dec. 15, 1992

[30] Foreign Application Priority Data

Dec. 25, 1991 [JP] Japan ..... 3-342560

[51] Int. Cl.[5] ..... D06H 7/00; B26D 7/01

[52] U.S. Cl. ..... 83/422; 83/451; 83/940; 269/21

[58] Field of Search ..... 83/14, 56, 422, 451, 83/940, 941; 269/21

[56] References Cited

U.S. PATENT DOCUMENTS 3,797,341 3/1974 Bystron ..... 83/451 X 4,907,479 3/1990 Nasu ..... 83/422

4,916,992 4/1990 Nasu ..... 83/451 X 4,993,296 2/1991 Nasu ..... 83/940 X 5,018,418 5/1991 Nasu ..... 83/451 X

*Primary Examiner*—Frank T. Yost

*Assistant Examiner*—Rinaldi Rada

[57] ABSTRACT

A laminate 88 placed on a supporting belt 3 is covered with an air-impermeable sheet 89. Air is withdrawn from suction ports 37 and 44 formed in upper surfaces of a number of belt support plates 9 constituting a first suction mechanism 34 and an upper surface of a second suction mechanism 35 disposed proximate to front and rear sides of a movable recess 6 formed in the supporting belt 3 through vent holes 3a formed in the supporting belt 3, respectively. The laminate 88 is supported on the supporting belt 3, and cut by a cutter 26 which is supported at upper and lower parts thereof.

1 Claim, 10 Drawing Sheets

APPARATUS FOR CUTTING LAMINATE

BACKGROUND OF THE INVENTION

This invention relates to a laminate cutting apparatus for automatically cutting a laminate consisting of multiple plies of a sheet material such as a fabric.

Heretofore, an automatic laminate cutting apparatus of the type mentioned above is disclosed in, for example, Japanese Patent Publication No. Sho 53-13836. In this conventional apparatus, a laminate such as a fabric to be cut is supported on a supporting surface of an air-permeable support member, and by withdrawing air from the under surface of the support member, the laminate is supported on the supporting surface in a compressed state. In that state, a knife-like cutter as a cutting tool is penetrated into the laminate from above, so that the laminate is cut into a desired shape.

The inventor of the present invention has also proposed a laminate cutting apparatus as discussed in Japanese Patent Application Laid-Open (KOKAI) No. Hei 1-306200. This conventional cutting apparatus includes a pedestal, a belt support mechanism provided with a number of belt support plates arranged in parallel in the longitudinal direction (forward and backward direction) so as to be raised and lowered, a laminate supporting belt supported on the pedestal through the belt support mechanism and capable of reciprocating longitudinally, and a travel body supported on the pedestal and capable of reciprocating longitudinally. The travel body is provided with a recess forming member for forming a movable recess having an open upper surface in a longitudinal part of the support belt, a cutter head capable of reciprocating transversely above the support belt, and a cutter receiving sleeve capable of reciprocating transversely within the movable recess in synchronism with this cutter head. A knife-like cutter is mounted on the cutter head with its tip portion inserted into the cutter receiving sleeve such that the cutter is capable of moving up and down. The pedestal is provided on both sides thereof with suction ducts having suction ports opening up at their opposing surfaces.

With this cutting apparatus, an air-permeable laminate such as a fabric, which is covered at all surfaces excepting side surfaces thereof with an air-impermeable sheet, is supported on the supporting belt, and air is withdrawn from both side surfaces of the laminate through the suction duct, so that the laminate is held in a compressed state on the supporting belt.

In that state, the cutter is lowered to insert its tip portion into the cutter receiving sleeve, the cutter head is reciprocated transversely, and the travel body is reciprocated longitudinally, whereby the laminate is cut into a desired shape.

Furthermore, as shown in Japanese Patent Application Laid-Open (KOKAI) No. Hei 1-199789, there is also known a laminate cutting apparatus, in which a movable recess is formed in a laminate supporting belt by a recess forming member secured to a moving pedestal on which a high speed jet cutter apparatus is mounted, a number of vent holes are formed in the supporting belt, a front and a rear suction boxes are secured to the moving pedestal and adapted to support the under surface of the supporting belt at a front and a rear locations of the movable recess, suction chambers each having an open upper surface are formed within the front and rear suction boxes, and the suction chambers are connected to the suction source.

In this cutting apparatus, the laminate is supported on the supporting belt in the compressed state by sucking air from the suction source via the suction chambers, suction ports and vent holes, and cut by hydraulic pressure of a high pressure jet stream from the jet cutter apparatus.

Since the laminate cutting apparatus shown in the aforementioned Publication No. Sho 53-13836 is a cantilever type cutter in which the laminate retained in a compressed state on the supporting surface by suction is penetrated by the knife-like cutter and the tip portion of the cutter is also penetrated in the area near the supporting surface of the support member, the tip portion of the cutter is twisted by resistance of the laminate and support member. The result is that a cut product of high accuracy is difficult to obtain. A band saw type cutter is sometimes used as a cutting tool. In this case, however, when the laminate is cut by the cutter, the laminate and the support member are simultaneously cut by the cutter. Since it is necessary to change the support member highly frequently, the working ratio is bad.

On the other hand, in the laminate cutting apparatus disclosed in the above-mentioned Japanese Patent Application Laid-Open No. Hei 1-199798, since the front and rear suction boxes are disposed at only the portion near the movable recess of the supporting belt and the laminate being supported on the supporting belt in the compressed state occurs at only the portion near the movable recess (in other words, the whole laminate is not sucked in the effective area for cutting the laminate), the laminate can be cut with high accuracy.

Particularly, in the case where the laminate is a fabric of a material having a raised nap such as velvet, moquette, or corduroy, when compressing and decompressing operations are performed repeatedly on the laminate, the laminate is gradually de-shaped in the direction where hairs of the fabric are fallen and a significant positional displacement is occurred between the upper layer fabric and the lower layer fabric, with the results that cutting accuracy is lowered and in addition, cutting becomes impossible to carry out.

With respect to the above-mentioned Publication No. Hei 1-306200, in the case where the sheet materials forming the laminate are not sufficient in air-permeating property, even if air is sucked with the suction ports of the suction ducts are abutted against both sides surfaces of the sheet materials, the intimately attaching force between the laminated sheet materials is weak at location away from the suction ports and the laminated state is collapsed due to cutting resistance of the cutter, with the result that a cut product of high accuracy is impossible to obtain. Furthermore, in the case of the one where the suction ports of the suction ducts are abutted against both side surfaces of the laminate, it is necessary to move the suction ducts in the transverse direction every time the width of the laminate is changed and therefore, it takes much time and labor and the working ratio is lowered.

SUMMARY OF THE INVENTION

It is therefore an object of the present invention to provide, in order to obviate the above problems, a laminate cutting apparatus, in which a generally entire surface of a laminate can be supported on the supporting belt in the compressed state irrespective of the material of the fabric forming the laminate, and a cut product of high accuracy can be obtain easily and efficiently.

To achieve the above object, there is essentially provided a laminate cutting apparatus, comprising: a pedestal; a laminate supporting belt mounted on the pedestal so as to be capable of reciprocating longitudinally; a belt support mechanism provided with a number of belt support plates arranged in parallel in a forward and backward direction and capable of moving up and down, the laminate supporting belt being supported on the belt support plates; a travel body supported on the pedestal so as to be capable of reciprocating longitudinally, the travel body being provided with a recess forming member for forming a movable recess having an open upper surface in the supporting belt, a cutter head capable of reciprocating transversely above the supporting belt, and a cutter receiving sleeve capable of reciprocating transversely within the movable recess in synchronism with the cutter head; and a knife-like cutter mounted on the cutter head with a tip portion thereof inserted into the cutter receiving sleeve such that the cutter is capable of moving up and down; the improvement further comprising: a first suction mechanism including a number of vent holes formed in the supporting belt, and suction passages formed in the belt support plates and having suction ports opened up at upper surfaces thereof respectively, and the suction passages being connected to a suction source through flexible hoses; and a second suction mechanism including a front and a rear suction boxes secured to the travel body and adapted to support an under surface of the supporting belt at locations proximate to front and rear ends of the movable recess; and suction chambers formed in the front and rear suction boxes and having suction ports opening up at upper surfaces thereof, the suction chambers being connected to the suction source.

In the operation of the laminate cutting apparatus of the present invention, a laminate consisting of multiple plies of a sheet material such as a fabric is placed at a predetermined position on the laminate supporting belt, and a generally entire portion of this laminate and the upper surface of the supporting belt exposed to atmosphere is covered with a flexible air-impermeable sheet. In that state, by sucking air from the suction ports of the suction passages formed in the number of belt support plates forming the first suction mechanism and the suction ports formed in the suction boxes of the second suction mechanism disposed at location proximate to the front and rear ends of the movable recess via the vent holes, the laminate and the air-impermeable sheet are held on the supporting belt such that the entire laminate can be compressed uniformly and reliably.

The above state is maintained, and the knife-like cutter is penetrated into the air-impermeable sheet and the laminate with the tip portion of the cutter inserted into and retained by the cutter receiving sleeve. In accordance with the transverse movement of the cutter head disposed at the travel body and with the longitudinal traveling of the travel body, the movable recess formed in the supporting belt and the cutter receiving sleeve disposed within the movable recess are moved in the longitudinal and transverse directions respectively in unison with the travel body and the cutter head, in order to perform a cutting operation to the laminate.

According to the present invention, since air can be generally uniformly sucked from the entire under surface of the laminate placed on the supporting belt, not only a laminate such as a normal fabric but also a laminate such as a sheet having an inferior air-permeating property or a fabric having a raised nap can be reliably supported on the supporting belt in the state the entire laminate is uniformly compressed. Moreover, the laminated state is not collapsed during cutting which otherwise occurs when the sheet materials forming the laminate are displaced. Furthermore, since the cutter is supported at upper and lower locations thereof and performs a cutting operation in that state, even if the laminate is cut into a complicated shape including an acute angle using a thin cutter, deformation owing to twisting of the cutter is seldom. As a result, a cut product of high accuracy can be obtained.

Furthermore, since the supporting belt is not cut by the tip portion of the cutter, the supporting belt is not required to be changed. Since it is not necessary to move the suction ducts in the transverse direction even when the width of the laminate is changed, the working ratio of the apparatus is improved and a cut product can be obtained efficiently.

DESCRIPTION OF THE PREFERRED EMBODIMENTS

Figure 1:
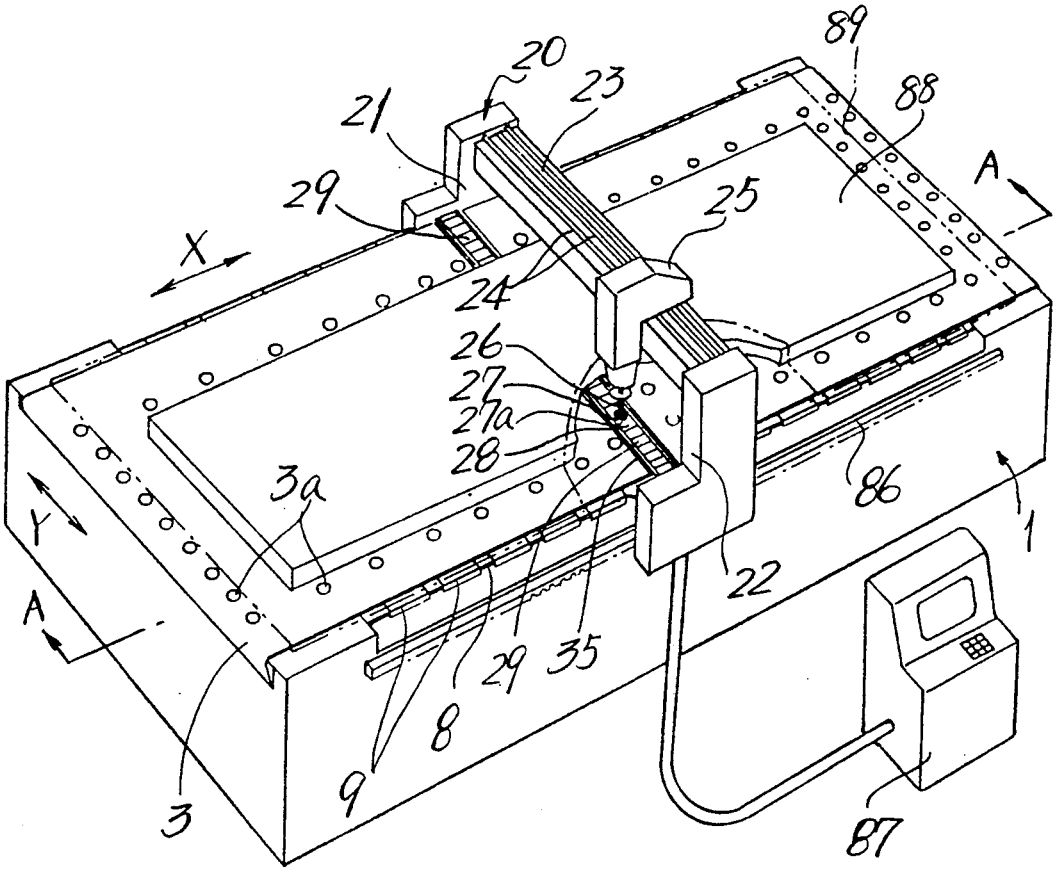
FIG. 1 is a perspective view showing a laminate cutting apparatus according to a first embodiment of the present invention.

One embodiment of the present invention will now be described with reference to the drawings.

In FIGS. 1, 2, 3 and 4, the numeral 1 denotes a rectangular pedestal whose length in the longitudinal (X) direction is longer than that in the transverse (Y) direction. Two belt guides 2 extending in the transverse direction are horizontally secured onto the pedestal 1, one at a front end and the other at a rear end thereof. A flexible laminate supporting belt 3 is supported on the front and rear belt guides 2.

This supporting belt 3 curves downward from half-circular external portions of the front and rear belt guides 2, and both ends of the belt 3 are connected to take-up rollers 4 rotatably disposed across lower parts of front and rear end portions of the pedestal 1 respectively. Belt drive motors 5 are installed at the front and rear end portions of the pedestal 1. The supporting belt 3 is taken up on one of the take-up rollers 4 by the motors 5 through an endless chain or an endless belt. The supporting belt 3 is formed of a flexible material such as a synthetic resin or a rubber. A number of vent holes 3*a*, each penetrating all the way through the thickness of the supporting belt 3, are arranged in parallel at predetermined spaces on the belt 3 in longitudinal and transverse directions, respectively.

A belt support mechanism 7 is disposed below the supporting belt 3. This belt support mechanism 7 is adapted to support the belt 3 at its portion other than a movable recess 6 and its vicinity which will be described later.

In this belt support mechanism 7, connecting belts 8 are disposed under the supporting belt 3, with front and rear end portions thereof secured to the front and rear belt guides 2 of the pedestal 1 respectively. The connecting belts 8 each having a generally same width as the supporting belt 3 are loosened by a predetermined amount.

Below the connecting belt 8, a number of rectangular belt support plates 9 elongated in the transverse direction are arranged at generally equal spaces in the longitudinal direction, the belt support plates 9 are connected by the flexible connecting belts 8 through suitable means, respectively, so as to be free to flex in the vertical direction, and each belt support plate 9 is provided with a bearing metal piece 10 extending downward therefrom, which is, in turn, rotatably provided with a pair of rollers 11.

The pedestal 1 is provided at a vertically intermediate portion thereof with a pair of guide rails 12 also serving as longitudinal beams longitudinally extending in horizontal postures along the pedestal 1. Carrier plates 13 and cam plates 14 are disposed between the belt support plates 9 and the guide rails 12.

Each carrier plate 13 is formed of a rectangular metal plate which is longer in the longitudinal direction than in the height direction. A plurality of such carrier plates 13 are disposed on both longitudinal sides of the cam plates 14, and a cam groove 15 of a generally inverted trapezoidal shaped is formed in an upper surface of the cam plate 14 at a vertical central portion thereof.

The carrier plate 13 is provided with a longitudinal slot 16 and a connecting pin 17, and the cam plate 14 is also provided at both end portions thereof with connecting pins 17. The connecting pin 17 of the cam plate 14 is slidably fitted into the longitudinal slot 16 of the carrier plate 13 adjacent to the cam plate 14, the connecting pin 17 of the carrier plate 13 is also slidably fitted into the longitudinal slot 16 of the adjacent carrier plate 13, and the carrier plates 13 of the both front and rear ends are secured to the front and rear end portions of the pedestal 1 by locking metal pieces 18.

A pair of rollers 19 are rotatably attached to lower end portions of the carrier plates 13 and cam plates 14 respectively, and these rollers 19 are travelably supported on the guide rails 12. The rollers 11 of the belt support plates 9 are supported on the upper surfaces of the carrier plates 13 and cam plates 14, and the supporting belt 3 is connected at the portion other than the movable recess 6 to the upper surfaces of the carrier plates 13 and the upper surfaces of the cam plates 14 other than the cam groove 15 portions through the belt supporting plates 9 and connecting belts 8.

Figure 2:
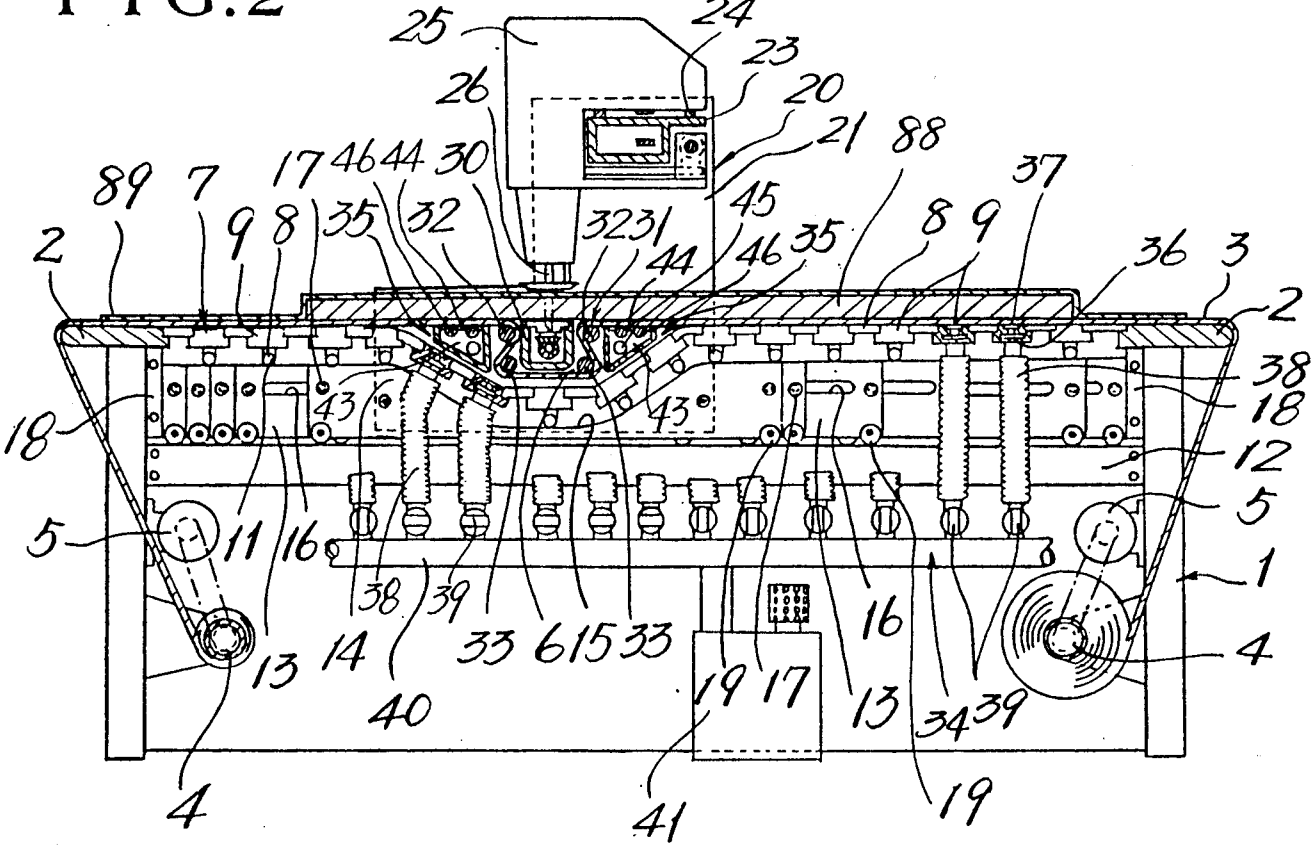
FIG. 2 is a vertical sectional view taken on line A-A of FIG. 1.
Figure 3:
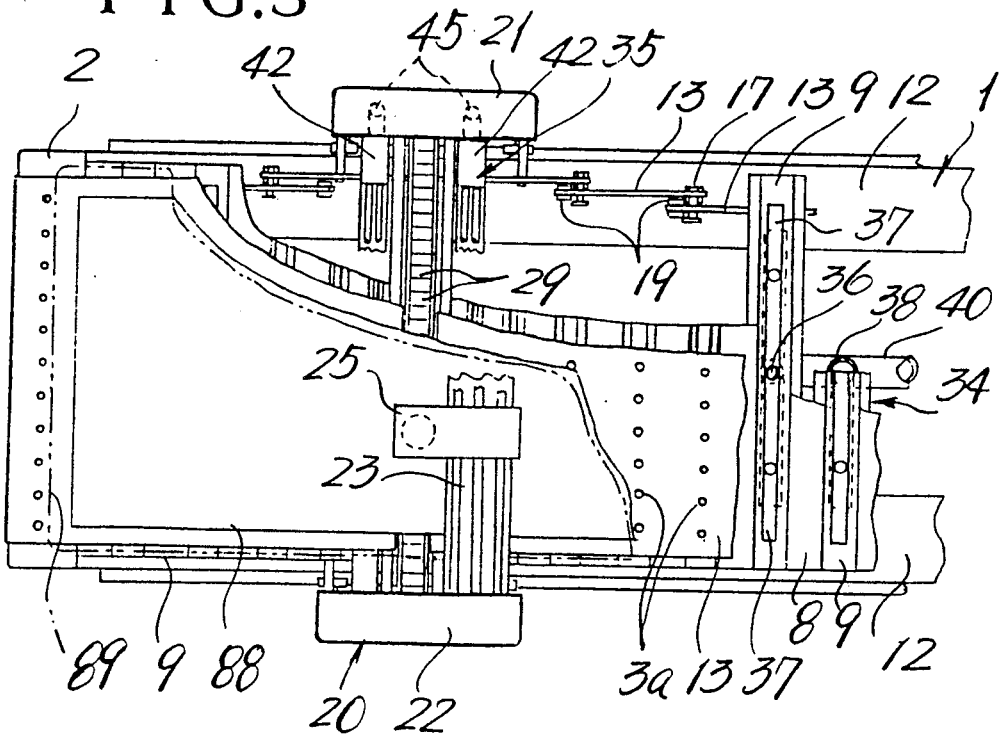
FIG. 3 is a plan view, partly exploded, of FIG. 1.
Figure 4:
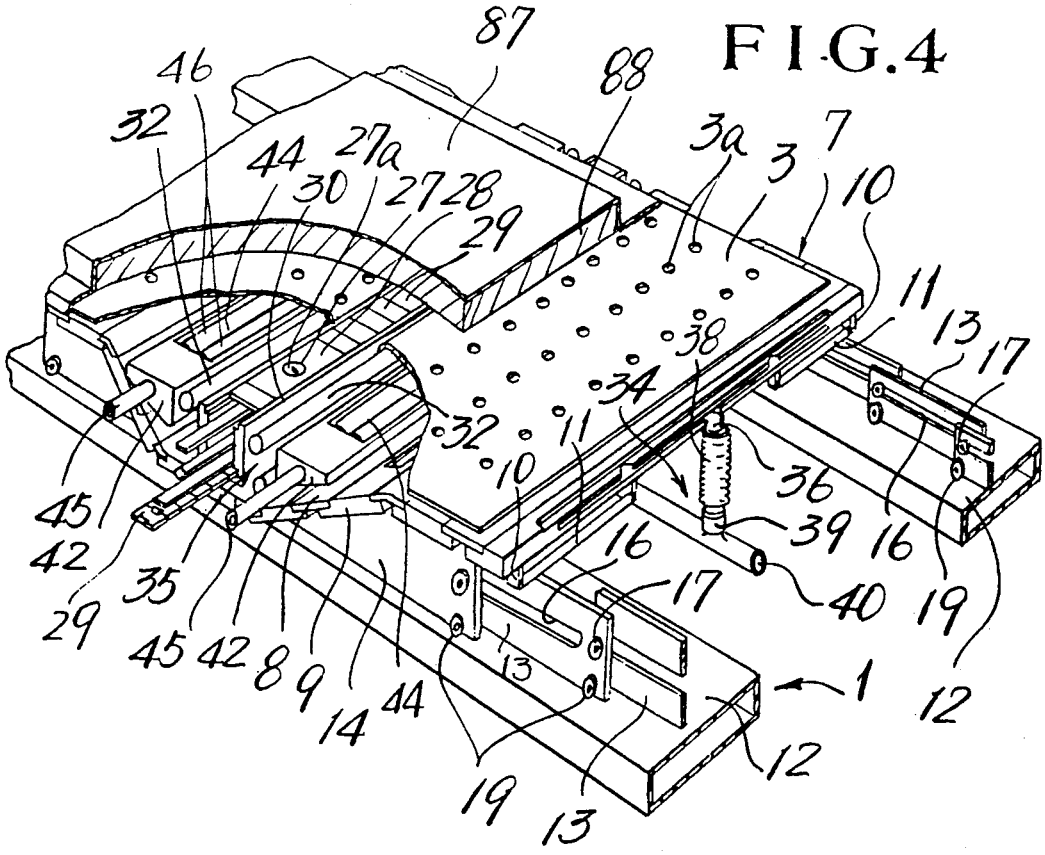
FIG. 4 is an enlarged perspective view, partly exploded, of FIG. 1.

As shown in FIGS. 1, 2 and 3, the pedestal 1 is provided with a travel body 20 capable of reciprocating in the longitudinal direction. The travel body 20 has both side members 21, 22 which are engaged with and supported by a pair of guide rails 99 disposed at external edge portions of the pedestal 1. A connecting beam 23 is provided to span the upper end portions of the side members 21, 22 of the travel body 20, and a cutter head 25, which is capable of reciprocating in the transverse direction, is supported on a head rail 24 which is provided on the connecting beams 23 in parallel relation.

A knife-like cutter 26 is supported on a cutter head 25 so as to be raised and lowered and turnable about a vertical axis. The cutter 26 extends vertically below the cutter head 25. Disposed below the cutter 26 is a cutter receiving sleeve 27 which is provided with a cutter support hole into which a tip portion of the cutter 26 is retractably inserted. The cutter 26 is raised and lowered by a cutter elevating mechanism having a crank mechanism, a drive mechanism (not shown) or the like disposed within the cutter head 25.

The cutter receiving sleeve 27 disposed below the cutter 26 is engaged with and supported by a receiving sleeve retaining member 28 so as to be turnable about a vertical axis. On both sides of the receiving sleeve retaining member 28, a number of closure plates 29 are linked in the transverse direction.

At the lower end portions of the side members 21, 22 of the travel body 20, a lower portion receiving member 30 having a generally U-shape in section is provided to span the side members 21, 22 of the travel body 20. The receiving sleeve retaining member 28 and the closure plates 29 are engaged with and supported by an upper portion of the lower portion receiving member so as to be reciprocated in the transverse direction.

As shown in FIG. 2, a recess forming member 31 is disposed between the lower portions of the side members 21, 22 of the travel body 20. The recess forming member 31 has four recess forming rollers 32, 33, two at its upper part and two at its lower part, disposed below the supporting belt 3 in such a manner as to surround the lower portion receiving member 30, and both end portions of the recess forming rollers 32, 33 are rotatably supported by the side members 21, 22. The supporting belt 3 is supported by the two recess forming rollers 32 located above from under, and by the two recess forming rollers 33 located below from above. The movable recess 6, which has an open upper surface and which gradually becomes long in the longitudinal direction toward a bottom surface thereof, is formed in the supporting belt 3 over the entire width thereof in the transverse direction. The movable recess 6 is located above the cam groove 15 of the cam plate 14 in such a manner as to oppose the cam groove 15.

This embodiment includes a first and a second suction mechanisms 34, 35 for sucking air from under the vent holes 3*a* formed in the supporting belt 3. In the first suction mechanism 34, a suction passage 36 is formed in each belt support plate 9 both ends of which slightly project from both side edges of the supporting belt 3, a suction port 37 of the suction passage 36 is opened up at the upper surface of the belt support plate 9, the suction passage 36 is connected at a central portion thereof to a suction pipe 40 through an expansible bellows-like flexible hose 38 and an electromagnetic stop valve 39, and the suction pipe 40 with front and rear ends thereof closed is disposed below the supporting belt 3 and extends horizontally in the longitudinal direction.

The suction port 37 is formed in such position and such size as being able to communicate with all vent holes 3*a* arranged in parallel in the transverse direction of the supporting belt 3. The electromagnetic stop valve 39 is automatically closed by suitable electric means not shown while the belt support plate 9 is located at the cam groove 15 portion of the cam plate 14.

In the second suction mechanism 35, a front and a rear suction boxes 42 are disposed at location proximate to the front and rear ends of the movable recess 6 of the supporting belt 6 and where they do not interfere with the belt support plate 9 within the cam groove 15, and both ends of the suction boxes 42 are secured to the lower end portions of the side members 21, 22 of the travel body 20, respectively. A suction chamber 43 is formed in each suction box 42, a suction port 44 of the suction chamber 43 is opened at the upper surface of the suction box 42, the suction port 44 is formed in such position and such size as being able to communicate with all vent holes 3*a* arranged in parallel in the transverse direction of the supporting belt 3, and one end of the suction chamber 43 is connected to a suction piping 45.

The suction pipe 40 of first suction mechanism 34 is connected at an intermediate portion thereof to a suction source 41 such as a vacuum pump, while the suction pipe 40 of the second suction mechanism 35 is connected to a suction source 41 through a flexible hose and a stop valve (both not shown). The suction source for the first and second suction mechanisms 34, 35 may be provided separately.

Furthermore, the suction chamber 43 is provided at the suction port 44 portion with auxiliary rollers 46 for supporting the supporting belt 3, and the auxiliary rollers 46 are rotatably axially supported on the both side members 21, 22 of the travel body 20.

Figure 5:
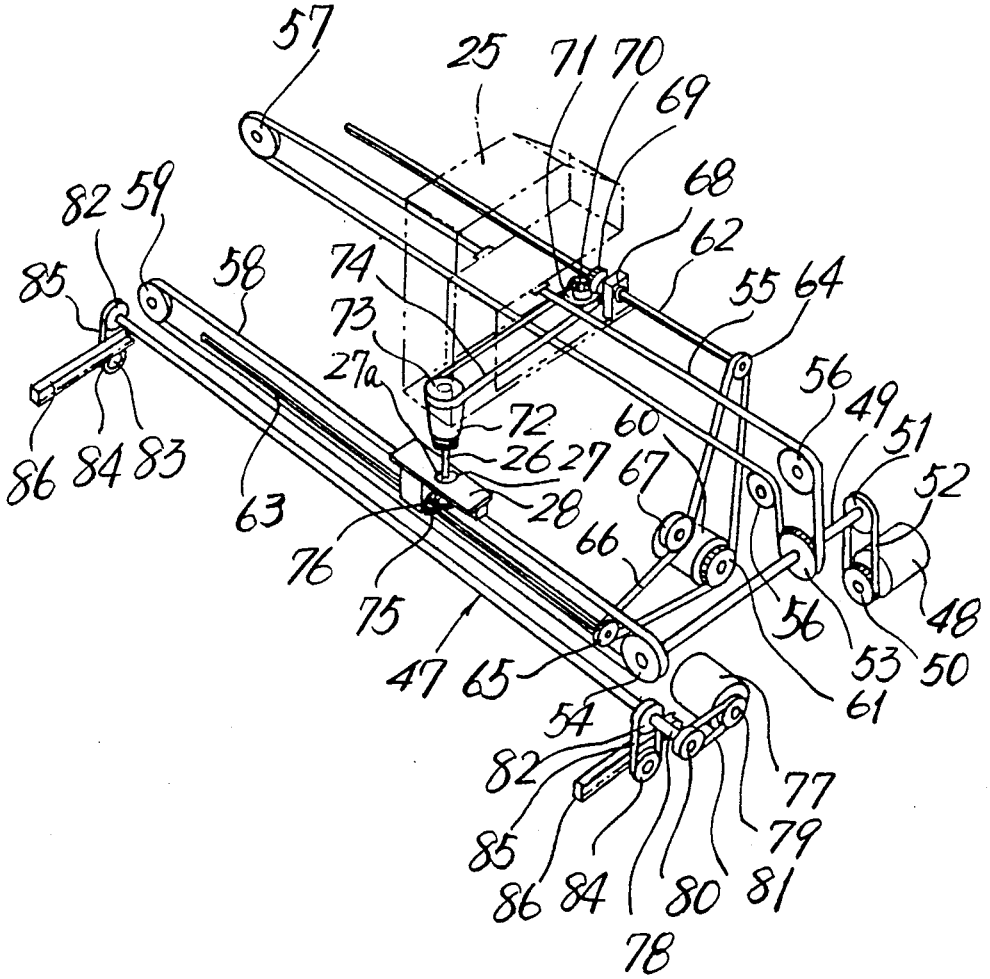
FIG. 5 is a perspective view showing a drive system of the cutting apparatus of FIG. 1.
Figure 6:
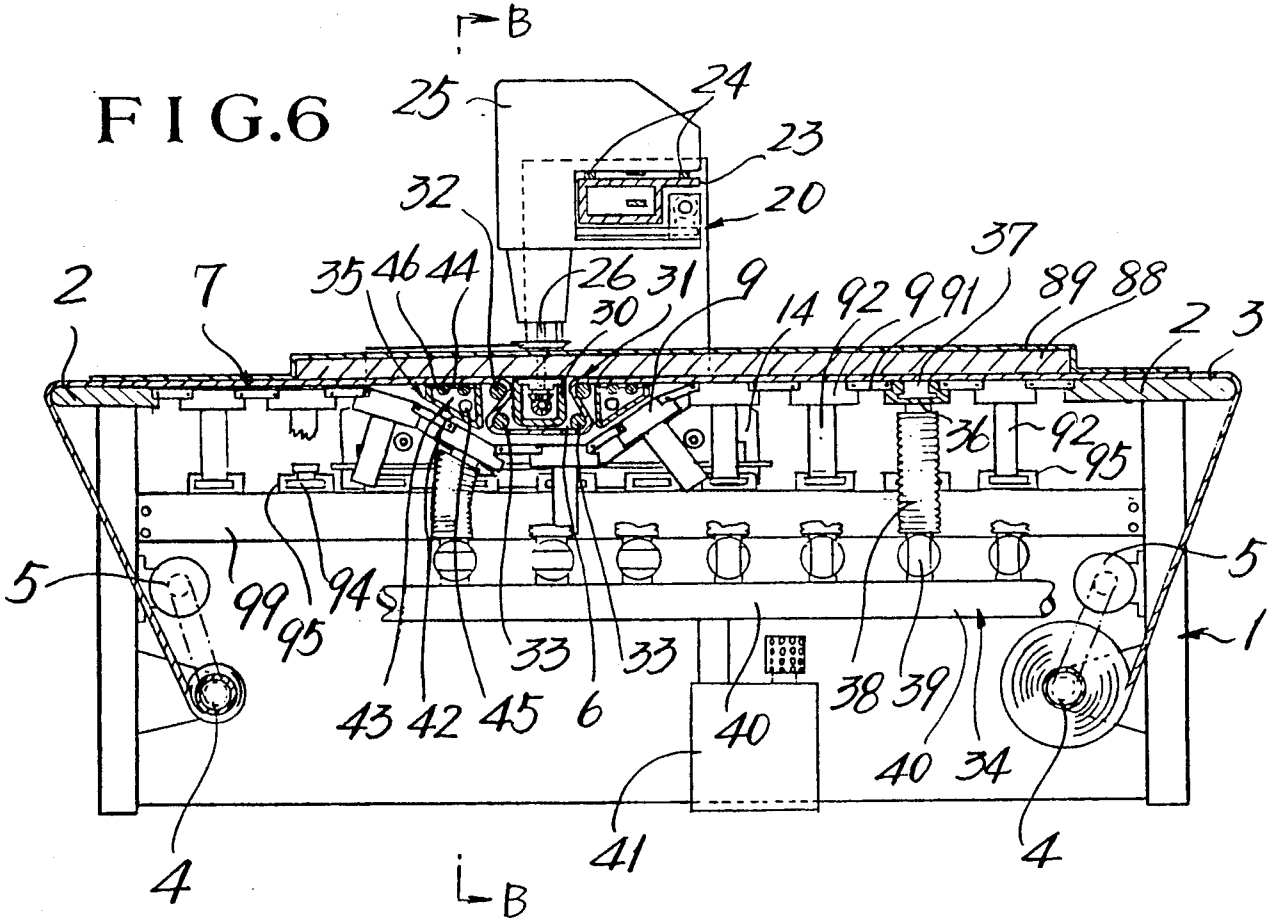
FIG. 6 is a side view, partly exploded, of a laminate cutting apparatus according to a second embodiment of the present invention.

As shown in FIG. 5, in a drive system 47 of this embodiment, a Y-axis (transverse direction) moving motor 48 is secured to the side member 22 (see FIG. 1) of the travel body 20, a connecting shaft 49 is rotatably supported on bearings (not shown) which are mounted on the both side members of the travel body 20, a timing belt 52 is meshed with a toothed pulley 50 of the Y-axis moving motor 48 and a toothed pulley 51 of the connecting shaft 49, and an upper and a lower toothed pylleys 53, 54 are secured to the connecting shaft 49 at two locations thereof. The upper toothed pulley 53 is meshed with an upper timing belt 55. The upper timing belt 55 is bent into the horizontal direction from the vertical direction by intermediate pulleys 56, 56 so as to be guided horizontally in the Y-axis direction and supported on an upper tension pulley 57 rotatably mounted on the other side member of the travel body, and both ends of the timing belt 55 are connected to the cutter head 25. The lower toothed pulley 54 is meshed with a lower timing belt 58. The lower timing belt 58 is supported on a lower tension pulley 59 rotatably mounted on the other side member and connected at both ends thereof to the receiving sleeve retaining member 28. Owing to the foregoing arrangement, upon reversible driving of the Y-axis drive motor 48, the cutter head 25 are reciprocally moved in the transverse (Y-axis) direction in synchronism with the receiving sleeve retaining member 28 and cutter receiving sleeve 27 by a single motor.

A cutter motor 60 is secured to a suitable location of the travel body 20, a timing belt 66 is meshed with a toothed pulley 61 of the cutter motor 60 and toothed pulleys 64, 65 secured to one end portions of an upper and a lower spline shafts 62, 63 rotatably supported by the side members of the travel body 20 and extending in the longitudinal direction, the timing belt 66 is pushed and tensioned by an intermediate pulley 67. The upper and lower spline shafts 62, 63 are rotatably supported on bearings (not shown) mounted on the side members of the travel body 20.

The upper spline shaft 62 is engaged with a spline nut 68 such that the spline nut 68 can be moved in the axial (longitudinal) direction. The spline nut 68 is supported on a suitable location of the cutter head 25 such that the spline nut 68 is capable of rotating but incapable of longitudinal movement. A drive side bevel gear 69 is secured to the spline nut 68, and a driven side bevel gear 70 of a longitudinal axis supported on the cutter head 25 meshes with the drive side bevel gear 69. A toothed pulley 71 integral with the driven side bevel gear 70 and a toothed pulley 73 mounted on a cutter guide 72 are meshed with a timing belt 74. The cutter guide 72 is rotatably supported on the cutter head 25 in order to turn the cutter 26 about a vertical axis.

The lower spline shaft 63 is axially movably engaged with a spline nut (not shown) which is supported on the receiving sleeve retaining member 28 such that the spline nut is capable of rotating but incapable of moving in the longitudinal direction. A drive side bevel gear 70 is secured to the spline nut, and a driven side bevel gear 76 of a longitudinal axis meshed with the drive side bevel gear 75 is coaxially secured to the cutter receiving sleeve 27 which is rotatably axially supported on the receiving sleeve retaining member 28.

Upon reversible driving of the cutter motor 60, the cutter 26 and the cutter receiving sleeve 27 are reciprocally turned in unison through the upper and lower spline shafts 62, 63, etc., in order to properly control the cutting direction.

An X-axis (longitudinal) traveling motor 77 is secured to a suitable location of the travel body 20, a connecting shaft 78 is rotatably disposed on bearings (not shown) mounted on both side members of the travel body 20, a toothed pulley 79 of the X-axis traveling motor 77 and a toothed pulley 80 secured to one end portion of the connecting shaft 78 are meshed with a timing belt 81, and toothed pulleys 82 having the same number of tooth are secured to both end portions of the connecting shaft 78. The tooth pulley 82 and a toothed pulley 79 integral with a pinion 83 disposed thereunder are meshed with a timing belt 85. The pinions 83 mesh with rack bars 86 (see also FIG. 1) secured to the lower portions of the guide rails of the pedestal in parallel relation in the longitudinal direction. Owing to the foregoing arrangement, upon reversible driving of the X-axis driving motor 77, the travel body reciprocates on the travel body rail in the longitudinal (X-axis) direction.

The three motors 48, 60 and 77 used herein are thervo-motors capable of numerical control. Based on data preprogrammed in a control board 87 of FIG. 1, the Y-axis moving motor 48, cutter motor 60 and X-axis traveling motor 77 are controlled respectively, the cutter 26 is properly directed, and the travel body 20 is traveled in order to perform a cutting operation.

Next, the cutting operation to the laminate by the cutting apparatus of this first embodiment will be described.

First, a laminate 88 consisting of multiple plies of a sheet material such as a fabric is placed on the upper surface of the supporting belt 3, the drive motor 5 of one of the take-up rollers 4 with the supporting belt 3 wound thereon is driven, the supporting belt 3 is paid out from the other take-up roller 4 to allow the first mentioned take-up roller 4 to take up in order to move the supporting belt 3 in the longitudinal direction to transfer the laminate 88 to a predetermined position, and the belt drive motor 5 is stopped.

Next, substantially whole part of the laminate 88 on the supporting belt 3 and upper surface of the supporting belt 3, which are exposed to atmosphere, are covered with a flexible air-impermeable sheet 89. In that state, the suction source 41 is driven, the electromagnetic stop valve 39 of the belt support plate 9 supported on the cam groove 15 of the cam plate 14 is closed, and all remaining electromagnetic stop valves 39 are opened to communicate the suction pipe 40 of the first suction mechanism 34 with the suction passage 36 of the belt support plate 9 through the flexible hose 38, whereby air is sucked from the suction ports 37 of the belt support plates 9 located in position other than the cam groove 15 portion via the vent holes 3*a* of the supporting belt 3. Simultaneously, by causing the suction source 41 to be communicated with the suction chamber 43 of the second suction mechanism 35, air is sucked from the suction ports 44 of the suction chamber 43 via the vent holes 3*a* of the supporting belt 3. By sucking action of air from the suction ports 37, 44, the laminate 88 and the air-impermeable sheet 89 are held on the supporting belt 3, and the whole laminate 88 is uniformly compressed on the upper surface of the supporting belt 3.

While maintaining the above state, the X-axis traveling motor 77 is driven to cause the travel body 20 to travel in the longitudinal direction, and the Y-axis moving motor 48 is driven to cause the cutter head 25 supported on the connecting beams 23 of the travel body 20 to move in the transverse direction in order to bring the cutter head 25 to a cutting start position on the laminate 88. At the same time, since the recess forming member 31 is moved in the longitudinal direction in accordance with the longitudinal traveling of the travel body 20, the movable recess 6 is also moved in the longitudinal direction. Along with the movement of the movable recess 6, the cam plate 14 is also moved in the longitudinal direction. Since the belt support plates 9 supported by the roller 11 on the upper surface of the cam groove 15 are changed, the electromagnetic stop valve 39 of the belt support plate 9, which is raised from the cam groove 15 portion, is opened. As a result, in accordance with the movement of the movable recess 6, the electromagnetic stop valve 39 of the belt support plate 9 are opened and closed.

Since the lower receiving member 30 is moved in the same direction as the travel body 20, the cutter receiving sleeve 27 is also moved in the same direction. Furthermore, the cutter receiving sleeve 27 is also moved in the transverse direction together with the closure plates 29 disposed at the lower receiving member 30 and the receiving sleeve retaining member 28 in synchronism with the transverse movement of the cutter head 25. As a result, the knife-like cutter 26 mounted on the cutter head 25 and the cutter receiving sleeve 27 are brought to cutting start position in such a manner as to vertically oppose each other.

The travel body 20, the cutter head 25, the lower receiving member 30, the receiving sleeve retaining member 28, etc. are stopped at the cutting start positions, and the cutter 26 is lowered by operating a cutter elevating mechanism (not shown). The cutter 26 is caused to penetrate into the upper portion of the laminate 88 of the air-impermeable sheet 89 and the laminate 88, with the tip portion thereof inserted into and supported by the support hole 27*a* of the cutter receiving sleeve 27.

In the above state, the X-axis traveling motor 77 and the Y-axis moving motor 48 are driven in accordance with a command from the control board 87, in order to move the cutter 26 and cutter motor 60 in unison, and the cutter 26 and the cutter receiving sleeve 27 are turned in the same direction in synchronism to properly direct the cutting edge of the cutter 26 in the proceeding direction, and at the same time, the laminate 88 is automatically cut together with the air-impermeable sheet 89 in accordance with a pattern based on the data preprogrammed in the control board 87.

The cutting apparatus of the first embodiment has the belt support mechanism 7 in which the supporting belt 3 is supported on the four recess forming rollers 32, 33 of the recess forming member 31 disposed at the lower part of the travel body 20, the longitudinally movable recess 6 is formed in a part of the supporting belt 3, the travel body 20 is provided at the lower part thereof with the lower receiving member 30 on which the transversely movable cutter receiving sleeve 27 is supported through the receiving sleeve retaining member 28, and the lower receiving member 30 is disposed within the movable recess 6. Accordingly, the belt support mechanism 7 is capable of supporting the lower surface of the supporting belt 3 including the movable recess 6 which is moved in accordance with the traveling of the travel body 20.

In this belt support mechanism 7, a number of belt support plates 9 are linked in the longitudinal direction, the under surface of the supporting belt 3 is supported at the area between the front and rear belt guides 2 other than the movable recess 6 is supported by these support plates 9, the lower ends of the belt support plates 9 are supported at a location below the movable recess 6 by the cam groove 15 of the cam plate 14 connected to the lower end portion of the travel body 20, and at the remaining portion by the carrier plates 13 on both sides of the cam plate 14, and the cam plate 14 and the carrier plate 13 are expansibly connected with each other in a superposed state, and travelably supported on the horizontal guide rails 12 of the pedestal 1.

Therefore, in accordance with the traveling of the travel body 20, the cam plate 14 and the recess forming member 31 are moved in unison, the movable recess 6 and the cam groove 15 are moved in the longitudinal direction in unison, the belt support plate 9 is supported on the upper surface of the cam groove 15 and guided to the vicinity of the movable recess 6 and then lowered at a good timing, thus enabling to avoid unfavorable interference with the movable recess 6, and when separated from the movable recess 6 and its vicinity, the belt support plates 9 are surely raised to support the supporting belt 3 in a horizontal posture, and leakage of suction air from between the upper surface of this belt 3 and the lower surface of the laminate 88 can be prevented.

Furthermore, in this embodiment, the number of vent holes 3a formed in the supporting belt 3 are communicated with the suction ports 40 formed in the upper surface of the support plates 9 at a portion other than the movable recess 6 and its vicinity, while in the vicinity of the movable recess 6, the vent holes 3a are communicated with the suction ports 43 of the front and rear suction boxes 42, and only the electromagnetic stop valves 39 located between the suction ports 40 of the belt support plates 9 located at the movable recess and its vicinity and the suction source 41 are closed and all the remaining suction ports 40 and 43 are communicated with the suction source 41. Owing to the foregoing arrangement, air can be sucked almost uniformly from each part of the under surface of the laminate 88 loaded on the supporting belt 3, the whole laminate 88 can be held on the upper surface of the supporting belt 3 in the uniformly compressed state, and the tip portion of the cutter 26 can be inserted into and retained by the cutter receiving sleeve 27 (in this way, the cutter 26 is supported at two locations), thus also enabling to prevent deformation or twisting of the cutter 26 during cutting operation. As a result, a cut product of high accuracy can be obtained.

In this embodiment, instead of the electromagnetic stop valves 39 disposed between the flexible hoses 38 and the suction pipe 40, stop valves automatically closed by mechanical means while the belt support plates 9 are at the cam groove 15 portion of each cam plate 14 may be used.

Figure 15:
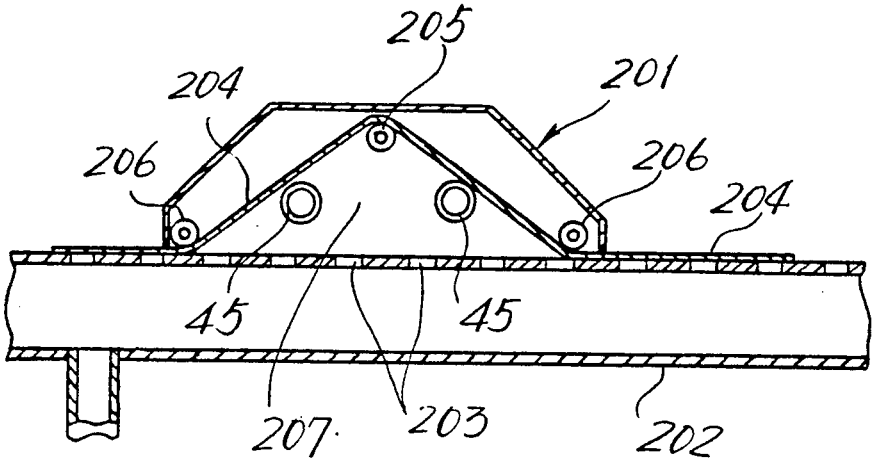
FIG. 15 is a partial vertical sectional view showing a construction of a mechanism for connecting a suction pipe of a second suction mechanism to a suction source.
Figure 16:
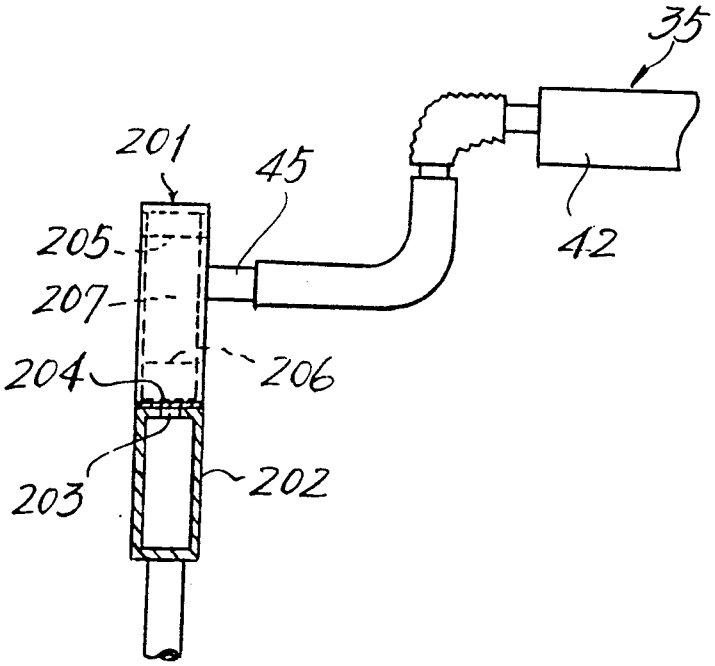
FIG. 16 is a partly cross sectional view of FIG. 15.

In this embodiment, as shown in FIGS. 15 and 16, the second suction mechanism 35 may be designed such that the suction pipings 45 are secured to a sucking movable box 201 having an open lower surface, a number of vent holes 203 are formed, at predetermined spaces in the longitudinal direction, on an upper surface of a rectangular longitudinal suction piping 202 in section secured to the pedestal in such a manner as to be parallel to the guide rails, a flexible seal tape 204, which is connected at front and rear end portions thereof to the pedestal, is supported on the longitudinal suction piping 202, the vent holes 203 are covered with the seal tape 204, the under surface of the seal tape 204 is supported on an upper roller 205 by the upper roller 205, and front and rear rollers 206 disposed within the suction box 201, and the upper surface at locations front and rear of this supporting portion is supported by the lower rollers 206, thereby forming a rectangular moving chamber 207 in section on the longitudinal suction piping 202, the suction pipings 45 are formed in this air chamber 207, and the longitudinal suction piping 202 is connected to the suction source.

In the above construction, air can be sucked from the suction pipings 45 through the longitudinal suction piping 202, vent holes 203 and moving air chamber 207 by actuating the suction source and the moving air chamber 207 can be moved in the longitudinal direction in accordance with the movement of the travel body without using any flexible hose.

FIGS. 6 through 10 shows a second embodiment of the present invention. The second embodiment is different with respect only to the belt support mechanism from the first embodiment. In FIGS. 6 through 10, like numerals to those indicating various parts of FIGS. 1 through 5 represent corresponding parts.

In the belt support mechanism 7 of the second embodiment, as shown in FIGS. 6 through 10, a number of belt support plates 9 disposed below the supporting belt 3 are pivotally connected to connecting members 91, and each belt support plate 9 is provided with support posts 92 secured to both end portions thereof and extending downward therefrom and with two pairs of rollers 11 rotatably supported on front and rear portions of both sides thereof.

The belt support plates 9 at both front and rear ends are connected to the front and rear belt guides 2 through the connecting members 91 respectively, and the belt support plates 9 and the connecting members 91 as a whole are loosened by a predetermined amount.

The pedestal 1 is provided at a vertically intermediate portion thereof with a pair of longitudinal beams 99 extending in horizontal postures. Receiving plates 94 are retractably transversely inserted into and retained by the longitudinal beams 99 by a receiving plate retaining mechanism 93 opposing the support posts 92. In the receiving plate retaining mechanism 93, a receiving plate holder 95 disposed below each belt support plate 9 is secured to the upper surface of the longitudinal beam 99, and the receiving plate 94 is transversely slidably fitted into and held by the receiving plate holder 95. A tension spring 97 is stretched between an external side surface of the longitudinal beam 99 and a pin 96 projecting downward from an external end of the receiving plate 94 in order to bias the receiving plate 94 transversely inwardly. The receiving plate 94 is provided at an under surface thereof with a stopper 98 adapted to abut with the external surface of the longitudinal beam 99.

Figure 7:
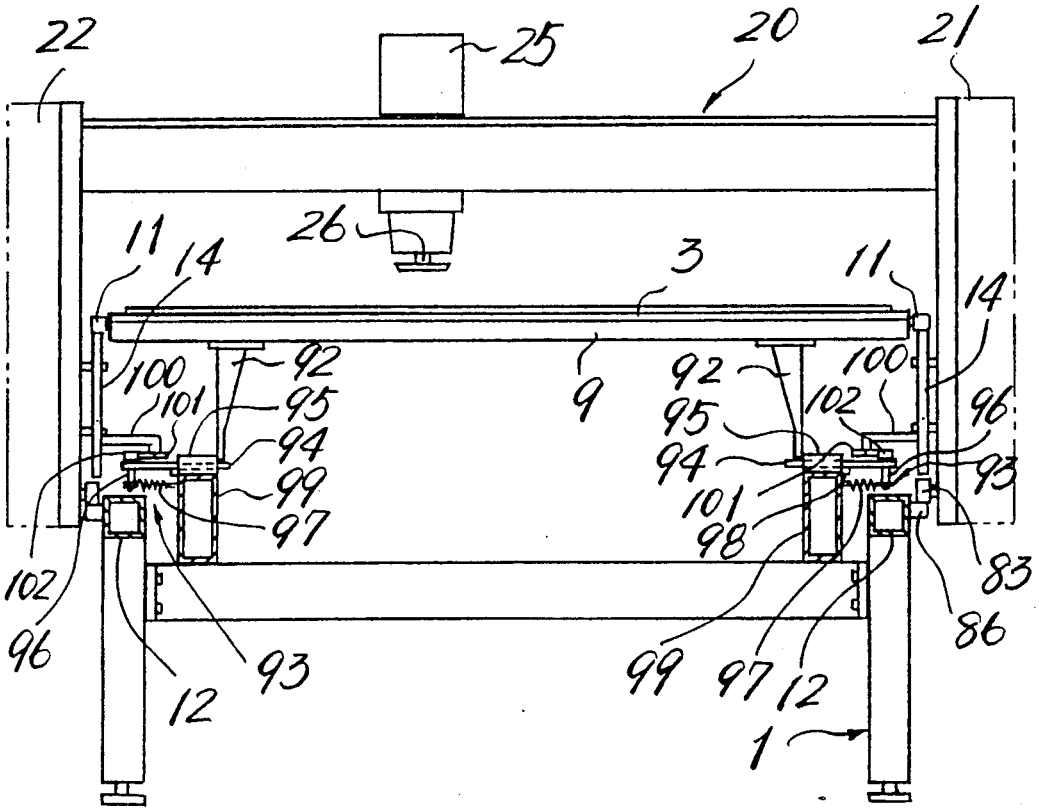
FIG. 7 is a generally cross sectional view taken on line B—B of FIG. 6.
Figure 8:
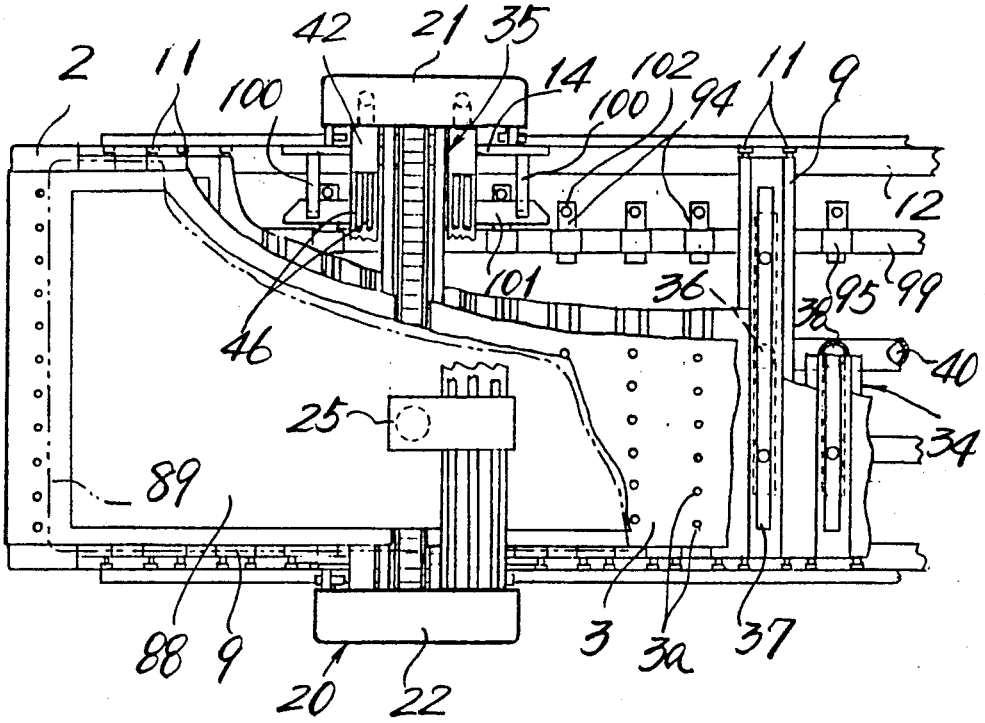
FIG. 8 is a plan view, partly exploded, of FIG. 6.
Figure 9:
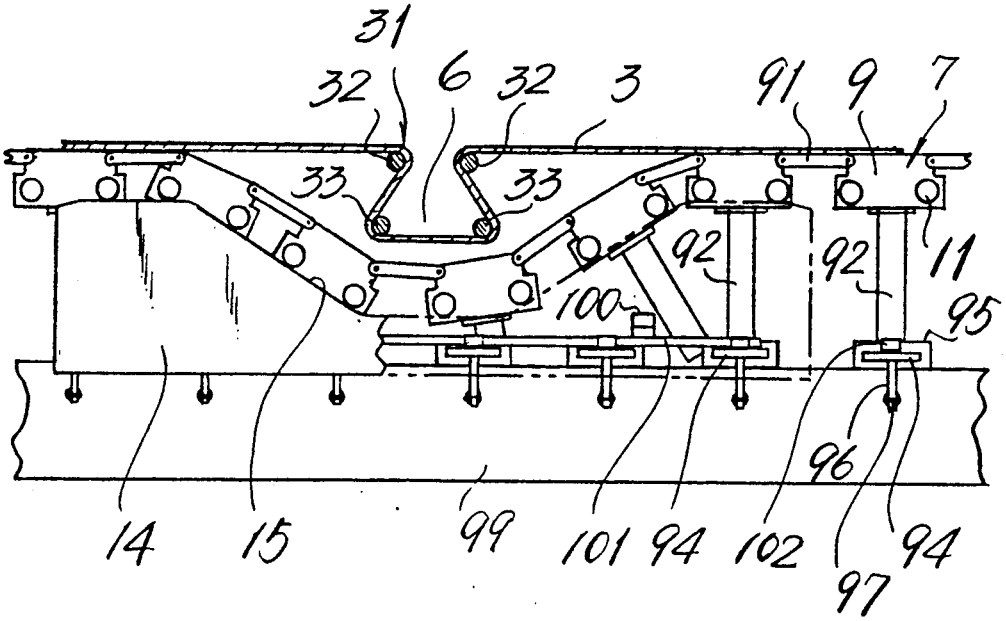
FIG. 9 is a partly enlarged explanatory view of FIG. 6.
Figure 10:
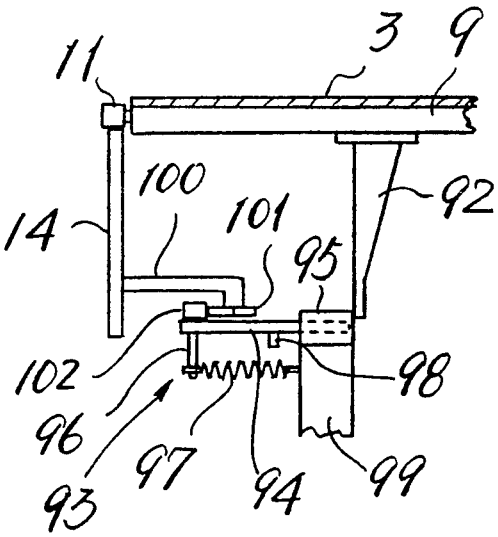
FIG. 10 is likewise a partly enlarged explanatory view of FIG. 7.

At a portion other than the movable recess 6 and its vicinity, as shown in FIG. 7, a lower end of the support post 92 is supported on the inner end of the receiving plate 94 inserted into the receiving plate holder 95, whereby the belt support plate 9 is maintained in its raised state. At the movable recess 6 and its vicinity, as shown in FIG. 10, the receiving plate 94 is retracted and the support post 92 is separated from the receiving plate 94, whereby the belt support plate 9 is lowered.

The travel body 20 has both side members 21, 22 which are engaged with and supported by a pair of guide rails 12 disposed at external edge portions of the pedestal 1. Cam plates 14 are secured to lower end portions of the side members 21, 22 respectively. The cam plates 14 are disposed outside of the guide rails 12 in such a manner as to support the rollers 11 of the belt support plates 9. Sweeping boards 101 of a trapezoidal shape in a plan view are secured to lower parts of the inner side of the cam plates 23 through mounting arms 100 respectively. Engaging rollers 102 of vertical shafts rotatably mounted on the external end portions of the receiving plates 94 are detachably engaged with the sweeping boards 101.

In the belt support mechanism 7 of the second embodiment, a number of belt support plates 9 are linked in the longitudinal direction, the areas between the front and rear belt guides 2 other than the movable recess 6 and its vicinity of the under surface of the supporting belt 3 are supported by these support plates 9, the support posts 92 extending downward from the belt retaining plates 9 are supported on the receiving plates 94, which are retractably inserted into and retained by the horizontal longitudinal beams 99 extending in the longitudinal direction of the pedestal 1 through the receiving plate retaining mechanism 93, at the movable recess 6 and its vicinity of the supporting belt 3 (i.e., a portion other than the cam groove 15 portion), and the four rollers 11 mounted on the belt support plates 9 are supported on the upper surface of the cam grooves 15 of the cam plates 14 secured to the side members 21, 22 of the travel body 20 at the cam groove 15 portion. Accordingly, the cam plates 14 and the sweeping boards 101 secured thereto are moved in unison with the travel body 20, and the sweeping boards 101 and the receiving plates 94 brought to the cam groove 15 location are engaged with each other through the engaging rollers 102, and the receiving plate 94 opposing the cam groove 15 is retracted.

As a consequence, the receiving plate 94 is separated from the support post 92 which is already brought to the cam groove 15 portion, to lower the belt support plate 9, and the belt support plate 9 located at the cam groove 15 portion is supported on the upper surface of the cam groove 15 by the roller 11. The belt support plate 9, which is already brought out of the cam groove 15 portion, is raised again by supporting the support post 10 on the receiving plate 94 inserted as a result of disengagement between the sweeping board 101 and the engaging roller 102 of the receiving plate retaining mechanism 93.

That is, each cam plate 14 has horizontal portions at front and rear parts of the cam groove 15, and after the roller 11 of the belt support plate 9 moving in the longitudinal direction climbs over the horizontal portions, the engaging roller 102 is engaged with the sweeping board 101, the receiving plate 94 is retracted outwardly in the transverse direction against the tension spring 97 in order to remove the supporting relation between the receiving plate 94 and the support post 92, and the belt support plate 9 is lowered.

After the belt support plate 9 is brought out of the cam groove 15 and climbs over the horizontal portions of the cam plate 14, the engaging roller 102 is separated from the sweeping board 101, and the tension spring 97 inserts the receiving plate 94 inwardly in the transverse direction by its restoring force. As a result, the support post when the support post 14 is brought to the front or rear part of the belt support plate 9, this belt support plate 9 is supported at the lower end of the support post 92 on the receiving plate 94.

It is preferable that each cam plate 14 is provided at front and rear end portions of its upper surface with curved portions or inclined portions respectively, and when the roller 11 is brought to the horizontal portion of the cam plate 14, the cam plate 14 is slightly higher than the belt support plates 9 which are located at front and rear parts of the cam plate 14.

The construction and operation of the remaining part of the second embodiment are the same as the first embodiment.

Figure 11:
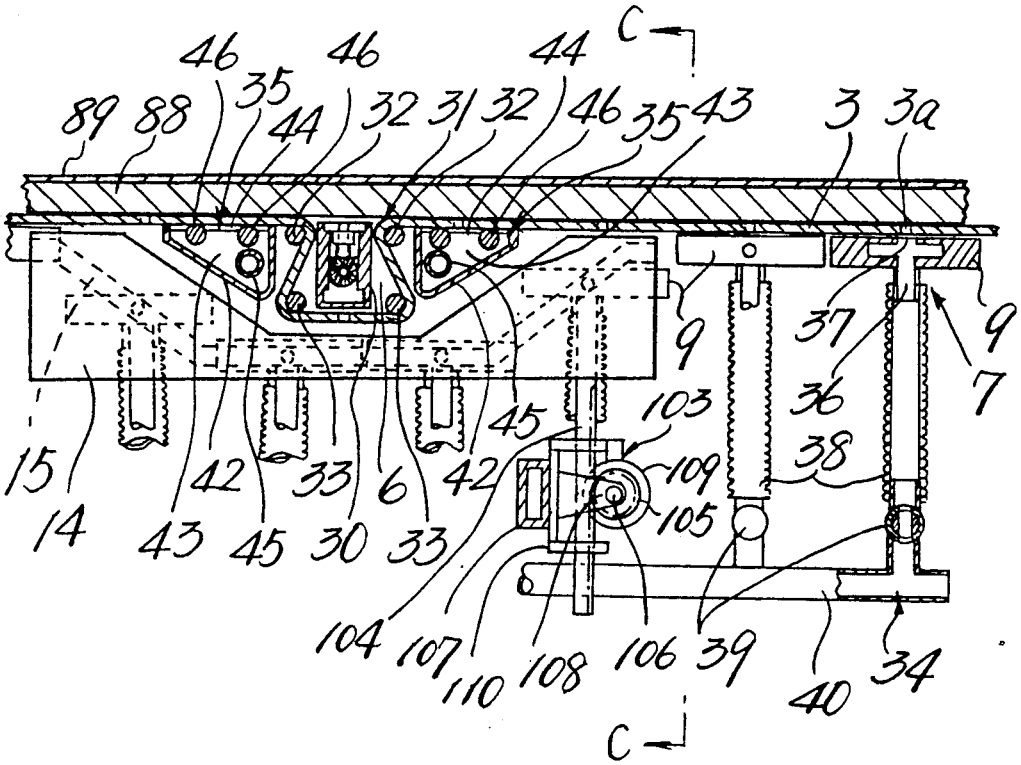
FIG. 11 is a partly cross sectional view showing a modified example of a belt support mechanism according to the present invention.
Figure 12:
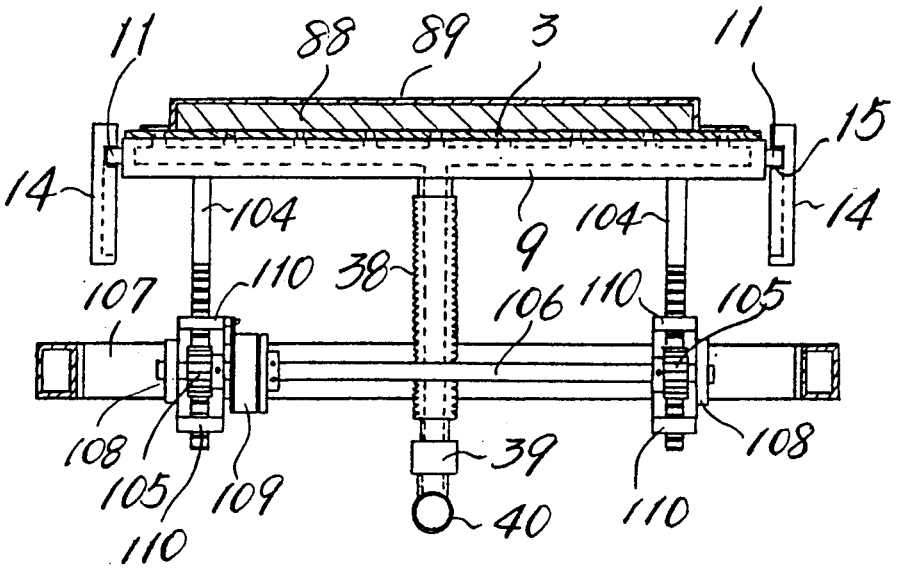
FIG. 12 is a sectional view taken on line C—C of FIG. 11.

Furthermore, the belt support mechanism of the present invention, as shown in FIGS. 11 and 12, may include the cam plates 14 and the belt support plates 9, each belt support plate 9 being provided with an elevating mechanism 103 as the one disclosed in Japanese Patent Application Laid-Open No. Hei 1-306220. In FIGS. 11 and 12, like numerals for various parts of FIGS. 1 through 5 represent corresponding parts.

That is, the elevating mechanism 103 is provided with circular rack bars 104 in section hanging down from two locations in the transverse direction of the under surfaces of belt support plates 9, and pinions 105 meshed with the rack bars 104 are secured to both end portions of connecting shafts 106. The elevating mechanism 103 is rotatably horizontally supported by support plate retaining members 107 secured to the pedestal 1 through bearings 108. Each connecting shaft 106 is provided with a brake 109, and the brake 109, only when required, is actuated to be released by electric control using electricity, air, hydraulic pressure, etc. Usually, the belt support plate 9 maintains its raised state so as to lock the connecting shaft 106 to the retaining member 107. The retaining member 107 is provided with a clamp member 110 adapted to slidably support the rack bar 104.

For moving the movable recess 6, the support plates 9, which support the under surface of the supporting belt 3 at a front location of the travel body which is not shown in FIGS. 11 and 12, is brought into a state able to be lowered owing to release of the brake 109 caused by suitable means for detecting approach of the cam plate 14 which is secured to the travel body under traveling. Subsequently, rollers 11 rotatably attached to the belt support plates 9 are brought into engagement with a cam groove 15, which is formed in the cam plate 14, in accordance with traveling of the travel body. As traveling of the travel body proceeds, the belt support plates 9, while maintaining their horizontal postures, are lowered below the movable recess 6. The belt support plates 9 located below the movable recess 6 are raised, one after another, first from one located behind guided by the cam groove 15 in accordance with traveling of the travel body. When the belt support plates 9 are separated from the cam plate 14, they support the under surface of a supporting portion of the supporting belt 3. In that state, the brake 109 stops its releasing action to lock the raised position, and then this locked state is maintained. Therefore, in accordance with the movement of the movable recess 6, the belt support plates 9, which are bought below the movable recess 6, are gradually changed one after another. Simply with the change of the belt support plates 9 in order, only the belt support plates 9 corresponding longitudinally to the cam plate 14 are located below the movable recess 6 and the under surface of the supporting belt 3 is normally supported by the number of remaining number of belt support plates 9.

The construction and operation of the remaining part of the belt support mechanism of FIGS. 11 and 12 are the same as the first embodiment.

In this embodiment, instead of the stationary belt guides 2 shown in FIG. 2, guide rollers rotatably supported on the pedestal by horizontal shafts may be used.

Figure 13:
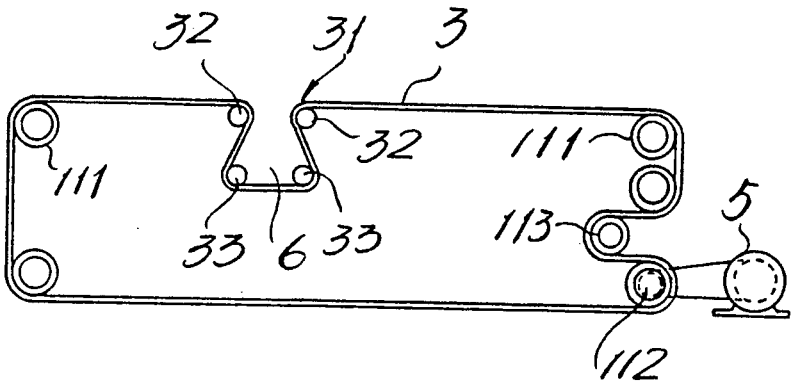
FIG. 13 is a side view showing a modified example of a supporting belt of the present invention.

In another modified embodiment of the present invention, as shown in FIG. 13, an endless supporting belt 3 is used, the upper portion of this supporting belt 3 is supported by a front and a rear carrier rollers 111, and a drive roller 112 driven by a belt drive motor 5 is urged to the inner peripheral surface of the supporting belt 3 by a tension roller 113, so that the supporting belt 3 is moved in the longitudinal direction owing to rotation of the drive roller 112.

Figure 14:
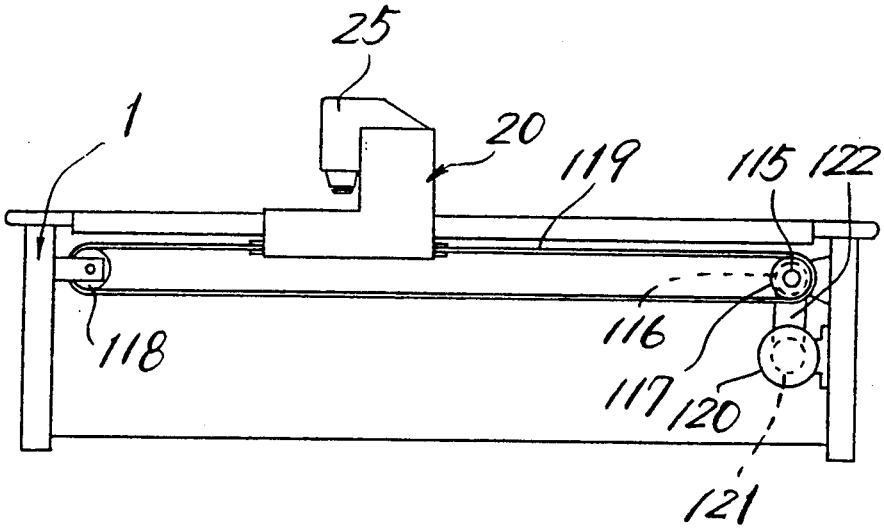
FIG. 14 is a side view showing a modified example of a travel body drive system of the present invention.

According to another modification of the present invention, as shown in FIG. 14, a connecting shaft 115 is transversely disposed to either of the front and rear end portions of the pedestal 1, the connecting shaft 115 is provided at a suitable location thereof with a toothed pulley 116, toothed pulleys 117 having the same number of teeth with each other are secured to both end portions of the connecting shaft 115, a driven pulley 118 is axially supported on the remaining end of the pedestal 1 in such a manner as to oppose the toothed pulley 117, these pulleys 117, 118 are looped with a timing belt 119, this timing belt 119 is secured to the travel body 20, a toothed pulley 121 is secured to an output shaft of an X-axis traveling motor 120 disposed at a suitable location of the pedestal 1, this pulley 121 and the toothed pulley 116 of the connecting shaft 120 are looped with a timing belt 122, and by reversible driving of the X-axis traveling motor, the travel body 20 is reciprocated in the longitudinal direction through the timing belt 122.

In the above mentioned embodiments of the invention, although drive force is transmitted from the motor using the timing belt and toothed pulleys, the drive force may be transmitted using a ball screw shaft, a chain, etc.

In this embodiment, a sheet of paper having an airpermeating property or a sheet of paper provided with a number of vent holes may be placed, where necessary in view of working, on the under surface of the laminate as an underlaying paper, so that the laminate is supported on the supporting belt through the underlaying paper and a cutting operation is performed in that state.

As described in the foregoing, in the laminate cutting apparatus according to the present invention, a laminate formed of a sheet material such as a fabric is placed on the laminate supporting belt at a predetermined location thereof, and a generally entire portion of this laminate and the upper surface of the supporting belt exposed to atmosphere is covered with a flexible air-impermeable sheet. In that state, by sucking air from the suction ports of the suction passages formed in the number of belt support plates forming the first suction mechanism and the suction ports formed in the suction boxes of the second suction mechanism disposed at location proximate to the front and rear ends of the movable recess via the vent holes, the laminate and the airimpermeable sheet are held on the supporting belt such that the entire laminate can be compressed uniformly and reliably.

While maintaining this state, the knife-like cutter is penetrated into the laminate, the tip portion of the cutter is penetrated into and retained by the cutter receiving sleeve, and in accordance with the transverse movement of the cutter head mounted on the travel body and with the longitudinal travel of the travel body, the movable recess portion formed in the supporting belt and the cutter receiving sleeve disposed in the movable recess are moved in the longitudinal and transverse directions in unison with the travel body and the cutter head in order to cut the laminate.

According to the present invention, since air can be generally uniformly sucked from the entire under surface of the laminate placed on the supporting belt, not only a laminate such as a normal fabric but also a laminate such as a sheet having an inferior air-permeating property or a fabric having a raised nap can be reliably supported on the supporting belt in the state the entire laminate is uniformly compressed. Moreover, the laminated state is not collapsed during cutting which otherwise occurs when the sheet materials forming the laminate are displaced. Furthermore, since the cutter is supported at upper and lower locations thereof and performs a cutting operation in that state, even if the laminate is cut into a complicated shape including an acute angle using a thin cutter, deformation owing to twisting of the cutter is seldom. As a result, a cut product of high accuracy can be obtained.

Furthermore, since the supporting belt is not cut by the tip portion of the cutter, the supporting belt is not required to be changed. Since it is not necessary to move the suction ducts in the transverse direction even when the width of the laminate is changed, the working ratio of the apparatus is improved and a cut product can be obtained efficiently.

What is claimed is:

1. A laminate cutting apparatus, comprising: a pedestal; a laminate supporting belt mounted on said pedestal so as to be capable of reciprocating longitudinally; a belt support mechanism provided with a number of belt support plates arranged parallel to each other and capable of moving up and down, said laminate supporting belt being supported on said belt support plates; a travel body supported on said pedestal so as to be capable of reciprocating longitudinally, said travel body being provided with a recess forming member for forming a movable recess having an open upper surface in said supporting belt, a cutter head capable of reciprocating transversely above said supporting belt, and a cutter receiving sleeve capable of reciprocating transversely within said movable recess in synchronism with said cutter head; and cutter mounted on said cutter head with a tip portion thereof inserted into said cutter receiving sleeve such that said cutter is capable of moving up and down; the improvement further comprising: a first suction mechanism including a number of vent holes formed in said supporting belt, and suction passages formed in said belt support plates and having suction ports at upper surfaces thereof respectively, and said suction passages being connected to a suction source through flexible hoses; and a second suction mechanism including a front suction box and a rear suction box secured to said travel body and adapted to support an under surface of said supporting belt at locations proximate to front and rear sides of said movable recess; and suction chambers formed in the front and rear suction boxes and having suction ports at upper surfaces thereof, said suction chambers being connected to said suction source.

* * * * *